US009133652B2

(12) United States Patent
Kachler et al.

(10) Patent No.: US 9,133,652 B2
(45) Date of Patent: Sep. 15, 2015

(54) TIRE-ENCIRCLING JUDDERBARRED CABLE LOOP

(71) Applicants: Thomas Stephen Kachler, Sunnyvale, CA (US); Robert Somers Kachler, Huntington Beach, CA (US)

(72) Inventors: Thomas Stephen Kachler, Sunnyvale, CA (US); Robert Somers Kachler, Huntington Beach, CA (US)

( * ) Notice: Subject to any disclaimer, the term of this patent is extended or adjusted under 35 U.S.C. 154(b) by 0 days.

(21) Appl. No.: 14/060,766

(22) Filed: Oct. 23, 2013

(65) Prior Publication Data

US 2015/0107312 A1 Apr. 23, 2015

(51) Int. Cl.
*E05B 73/00* (2006.01)

(52) U.S. Cl.
CPC ..... *E05B 73/0005* (2013.01)

(58) Field of Classification Search
CPC ..... E05B 73/0005
USPC ..... 70/14, 15, 18, 30, 49, 58, 233, 225, 70/226; 404/15; 119/771; 294/74; 47/43; D8/333
See application file for complete search history.

(56) References Cited

U.S. PATENT DOCUMENTS

| | | | | | |
|---|---|---|---|---|---|
| 1,571,057 | A * | 1/1926 | Kroll | 70/15 |
| 4,171,840 | A * | 10/1979 | Berzenye | 294/74 |
| 4,222,198 | A * | 9/1980 | Napolitano et al. | 47/43 |
| 5,003,929 | A * | 4/1991 | Dean | 119/784 |
| 5,492,383 | A * | 2/1996 | Kentner, Sr. | 294/74 |
| 6,282,836 | B1 * | 9/2001 | Goode et al. | 47/43 |
| 7,426,905 | B2 * | 9/2008 | Honeycutt | 119/795 |
| 2011/0219826 | A1 * | 9/2011 | Jeli et al. | 70/15 |

* cited by examiner

*Primary Examiner* — Joshua Kennedy
(74) *Attorney, Agent, or Firm* — Sean D. Burdick

(57) ABSTRACT

A tire-encircling judderbarred cable loop is an assembly that includes a loop of steel cable partially concentrically enclosed by a thick flexible sleeve, thereby defining an enclosed judderbarred portion of the cable and an exposed hitching portion of the cable. The area of the loop is large enough to encircle a contact area of an automobile tire. The flexible sleeve and the judderbarred portion collectively possess sufficient size and hardness to impart a humanly perceptible juddering signal to a driver of the automobile when the tire rolls over the enclosed portion. When the tire rests within the loop, the loop is confined and the weight of the automobile arrests movement of any object hitched to the hitching portion of the cable.

5 Claims, 3 Drawing Sheets

SECTION BB

SECTION AA

SECTION BB

SECTION AA

TIRE-ENCIRCLING JUDDERBARRED CABLE LOOP

BACKGROUND OF THE INVENTION

1. Field of the Invention

The present invention relates generally to mechanical locking devices, and more specifically to keyless or passive cable locks designed for use with automobiles.

2. Description of Related Art

The problem being solved by the present invention is how to provide a simple and reliable means for hitching something of value to a parked automobile to prevent loss and discourage theft. In an isolated location, such as out in the desert, on a mountain road, on the side of a highway, at a campground, or in the midst of a large parking lot, where the vehicle itself provides the only stationary anchoring point, how might the motorist temporarily tie his dog, his bicycle, his portable grill, or tool box or other valuable belongings to the vehicle?

Today, a motorist would likely solve the problem in a mundane way, as there are few, if any devices currently available that specifically address the problem. The motorist may tie a rope to a door handle; however, today's automobile door handles are lift-type latches that cannot accommodate a knotted rope. The motorist may tie the rope to a trailer hitch or to a luggage rack, if his vehicle is so equipped. Or the motorist might pass a length of chain around a bumper or grill, or around some part of the vehicle undercarriage. These solutions may or may not be available to the motorist, depending on how the vehicle is equipped, and in any case each solution is accompanied by some degree of inconvenience. In an unfortunate scenario, the aforementioned solutions can backfire on an absent-minded motorist who drives away while forgetting that something of value is hitched to the car.

The present disclosure illustrates a safe, convenient, and effective solution to the problem.

SUMMARY OF THE INVENTION

The present invention provides an engineered design for a passive locking device for hitching an object to an automobile. Generally, the invention embodies a cable assembly formed into a loop that is sized to encircle an automobile tire. When encircling the tire of a parked car, the car acts as an anchor that prevents the cable assembly from being removed. A hitching portion of the cable assembly allows objects of value to be conveniently hitched to the cable and thus to the car.

The invention may be embodied as a locking or hitching device that comprises a loop of cable and a flexible sleeve substantially concentrically enclosing a major portion of the cable while exposing a hitching portion of the cable. The loop is configured to encircle a contact area of an automobile tire, and the concentrically enclosed major portion of the cable is configured with sufficient hardness and thickness to impart a humanly perceptible juddering signal to a driver of the automobile when the tire rolls over the enclosed portion of the cable. A hitching ring may be fixed to the exposed portion of the cable. Pipe caps with through-holes for the cable may be fixed to the sleeve ends to secure the assembly and to confine the hitching ring to the hitching portion of the cable.

In terms of exemplary materials, the cable may be a plastic-coated stranded steel cable having a diameter of about one-quarter inch, and may be formed into a loop of about one to two square feet in area by crimping or welding together the ends of the cable. The flexible sleeve may be a dielectric material such as synthetic rubber tubing, or a plastic hose material such as a polyurethane-PVC alloy with polyester reinforcement. One or many such sleeves may be concentrically arranged to achieve an outer diameter and overall thickness for the cable assembly on the order of one inch or greater. The pipe caps and hitching ring may be formed from metal or plastic.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

Figure 1:
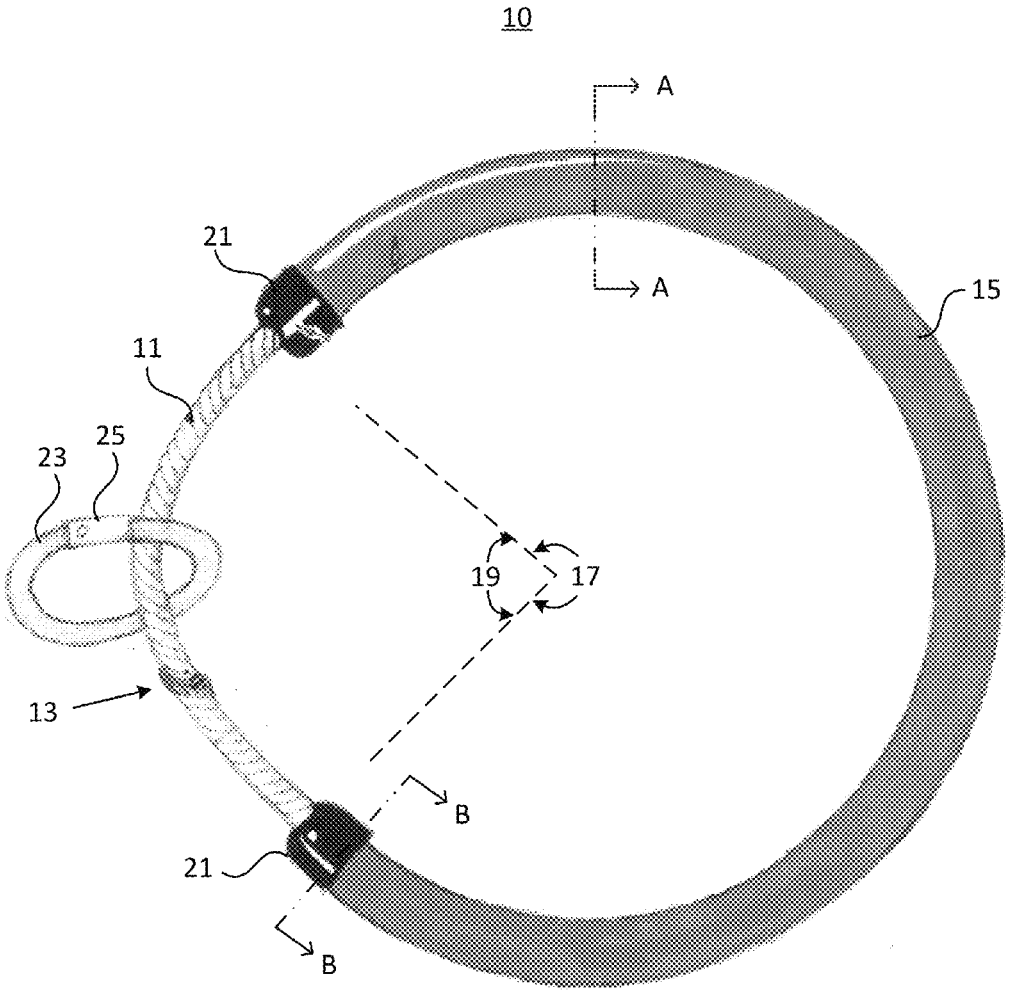
FIG. 1 is a top view of one embodiment of a tire-encircling judderbarred cable loop according to the invention.

The following disclosure presents exemplary embodiments for a tire-encircling judderbarred cable loop according to the invention. Generally, the invention embodies a cable assembly formed into a loop that is sized to encircle an automobile tire. When encircling the tire of a parked car, the car acts as an anchor that prevents the cable assembly from being removed. A hitching portion of the cable assembly allows objects of value to be conveniently hitched to the cable and thus to the car. The size and hardness of materials that form the cable assembly are selected to withstand the load of an automobile, and also to impart a humanly perceptible juddering signal to a driver of the automobile when the tire rolls over an insulated portion of the cable.

The term judderbarred as used herein means that an object has been intentionally thickened or otherwise configured to impart a humanly perceptible mechanical shock or vibration to a driver of a vehicle when a wheel or tire of the vehicle rolls over the object so thickened. Judderbarred is derived from judder bar, which is a synonym in New Zealand English for a speed bump. To judder means to vibrate conspicuously. Thus, a judder bar or judderbar is a device that is intended to cause a conspicuous vibration.

The term juddering signal is a vibration or shock caused by a judderbar. A juddering signal as used herein may be a low frequency signal within the passband of a typical passenger vehicle suspension system.

The term hitching portion as used herein means an exposed length of cable that is not judderbarred. The exposed length of cable may be a non-judderbarred stranded cable with or without a thin coating of protective plastic, in the condition in which cable is typically sold per foot as a hardware commodity.

The term concentrically enclosing as used herein means that, with respect to the outer part in a cross sectional view of inner and outer parts having circular cross sections, the outer part substantially entirely surrounds the inner part, as in concentric circles. The term concentrically enclosing also assumes some reasonable amount of tolerance beyond perfect concentricity.

The term contact area as used herein means that area of a tire or wheel that comes into direct contact with the ground. The term is synonymous with the lowermost surface of a tire that is flattened against the ground under weight of the vehicle that it supports. Contact area also means the smallest area that circumscribes all flattened parts of a wheel or tire that are in contact with the ground.

The term humanly perceptible as used herein refers to a shock or vibration signal having a magnitude substantial enough to be sensed with certainty by a human being sitting in the driver's seat of a vehicle through the suspension system of the vehicle through normal sense of touch without electronic amplification or other transduction of the signal. The type of vehicle relevant to this definition is any automobile in the size range of compact car to large truck or SUV, i.e. an automobile having a curb weight in the range of about 2,830 lbs to about 6,000 lbs.

An exemplary embodiment for a tire encircling judderbarred cable loop 10 according to the invention is shown in FIG. 1. Judderbarred cable loop 10 is an assembly that includes a length of cable 11 that is formed into a loop. The cable 11 may be formed into the loop by attaching together opposite ends of the length of cable by any conventional means, such as welding, splicing, or crimping with a cable crimp (not shown). In this example, the opposite ends of cable 11 are welded together at attachment point 13. The size of the loop is such that it is capable of encircling a contact area of an automobile tire. In one embodiment, the loop is configured to encircle an area in the range of about one square foot to about two square feet.

The cable 11 must possess hardness and strength to withstand the weight of an automobile. As such, the cable 11 should be formed from a material such as steel. In one embodiment, cable 11 consists of a stranded steel cable that is one-quarter inch in diameter. Larger diameter cables may also be used. In addition, cable 11 may be galvanized or plastic coated, or both, to help prevent material degradation due to wear or rust.

Judderbarred cable loop 10 also includes a flexible sleeve 15 that concentrically encloses a portion of the cable 11. The portion of the cable 11 that is enclosed by the flexible sleeve 15 and the flexible sleeve 15 itself constitute a judderbarred portion 17 of the cable assembly 10. In a preferred embodiment of the invention, the judderbarred portion 17 includes a major portion of the cable 11. That is, it covers over half the length of the cable. As shown in the exemplary embodiment of FIG. 1, the judderbarred portion 17 comprises about two-thirds of the cable loop arc length. The remaining minor portion of the cable 11 that is not enclosed by the flexible sleeve 15 constitutes a hitching portion 19 of the cable assembly 10. In one embodiment, the hitching portion 19 is about eight inches in arc length. In another embodiment, the hitching portion 19 includes the attachment point 13.

The flexible sleeve 15 should be a durable, resilient material such as a synthetic rubber or reinforced plastic such as commercial grade hose or tubing suitable for use in plumbing systems. In one embodiment, the flexible sleeve 15 is composed of a polyurethane-PVC alloy with polyester reinforcement. In another embodiment, the flexible sleeve 15 may comprise multiple concentric lengths of flexible hose or flexible tubing. Whether a singular tube or multiple concentric tubes, the flexible sleeve 15 when enclosing the cable 11 should form a judderbarred portion 17 having an outer diameter of at least one inch. This minimum diameter, composed of the aforementioned materials, has been determined by the inventor to cause a humanly perceptible juddering signal sufficient to alarm a driver of a vehicle when a tire of the vehicle is driven over the judderbarred portion of the cable loop. Larger diameter sleeves 15 may also be employed in other embodiments of the invention.

An embodiment of a judderbarred cable loop 10 may also include one or more pipe caps 21, but preferably two pipe caps 21. Each pipe cap 21 covers an end of the flexible sleeve at the location where the hitching portion 19 of the cable loop borders the major or judderbarred portion 17 of the cable loop. The pipe cap 21 may be configured with a through-hole that allows the pipe cap to be concentrically threaded onto the cable 11. The pipe cap 21 may be further configured or selected to possess an inner diameter of approximately the same dimensions as the maximum outer diameter of the flexible sleeve 15, to ensure a snug fit when placing the end of the flexible sleeve into the pipe cap. Alternatively or in addition, a bonding agent such as epoxy may be used to affix the pipe cap 21 to the end of the sleeve.

The judderbarred cable loop 10 may also include a hitching ring 23 that is linked to or encircles that portion of the cable 11 that lies within the hitching portion 19 of the assembly. The hitching ring 23 is preferably a metal ring or loop made from hardened steel. In one embodiment, the hitching ring 23 comprises a closed and unbreakable ring. In another embodiment, such as the embodiment shown in FIG. 1, the hitching ring comprises an openable or breakable ring such as a carabiner having a spring loaded gate 25. As shown in FIG. 1, the judderbarred cable loop 10 is configured so that hitching ring 23 is free to travel along the hitching portion 19 between the pipe caps 21. The hitching ring 23 should be sized so that the hitching ring is too small to pass over a pipe cap 21. In other words, the judderbarred cable loop should be configured to prevent travel of the hitching ring 23 beyond the hitching portion 19. This may be accomplished by selecting or configuring a hitching ring so that that the maximum diameter of the hole within the hitching ring is less than the minimum outer diameter of the pipe cap 21. Alternatively, a second ring or carabiner (not shown) may be linked to the hitching ring to interfere with passage of the hitching ring 23 over the pipe cap 21, and thereby prevent travel of the hitching ring beyond the pipe cap.

Figure 2:
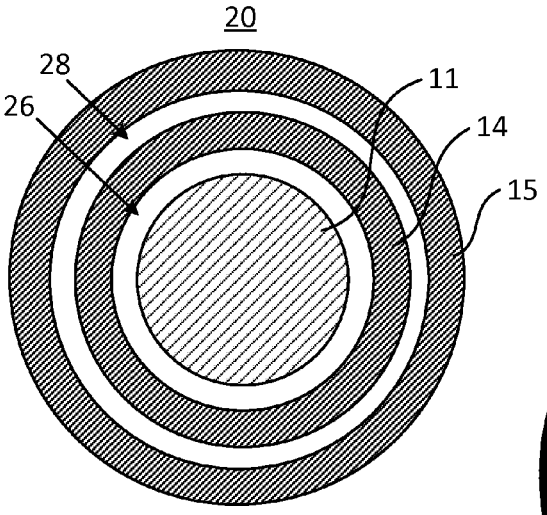
FIG. 2 is a cross-sectional view of one embodiment of a tire-encircling judderbarred cable loop having multiple flexible layers.

FIG. 2 shows a cross-sectional view of an embodiment 20 of a tire-encircling judderbarred cable loop according to the invention. The cross section is taken at view AA in FIG. 1. This view illustrates that a judderbarred cable loop may be composed of multiple concentric layers of material. In this embodiment, the innermost material at the core of the assembly is the cable 11. Moving outward, the next layer of material is an innermost layer of flexible hose or flexible tubing 14. Continuing on, the next layer of material is an outermost layer of flexible hose or flexible tubing. Either or both of the layers 14 and 15 may be composed of any of the aforementioned dielectric materials disclosed for use as the flexible sleeve. In one embodiment, at least one of the layers of flexible tubing comprises a reinforced plastic hose having a thickness of about three-sixteenth inches.

The cross-sectional view of cable loop 20 also shows an inner air gap 26 located between the cable 11 and the innermost flexible layer 14, and an outer air gap 28 located between the innermost flexible layer 14 and the outermost flexible layer 15. The presence of any of these air gaps is not essential to the invention. Rather, their presence indicates that considerable dimensional tolerance is allowed when fitting the layers together to form the cable loop assembly. Because assembly of the cable loop may require threading inner layers into outer layers, a tolerance between the maximum outer diameter of an inner layer and the minimum inner diameter of the outer layer is desirable to facilitate assembly. Such a tolerance is especially helpful when forming the assembled layers into a loop. So formed, the air gaps 26 and 28 will appear predominantly on the outer circumferential side of the assembly, rather than being concentrically oriented, as shown. Despite the fact that such tolerances may cause concentricity among the layers to vary a small degree, for purposes of the present invention, concentric orientation of any two layers includes an orientation in which the layers are slightly off-center due to the presence of the air gaps and to the circular formation of the loop.

Figure 3:
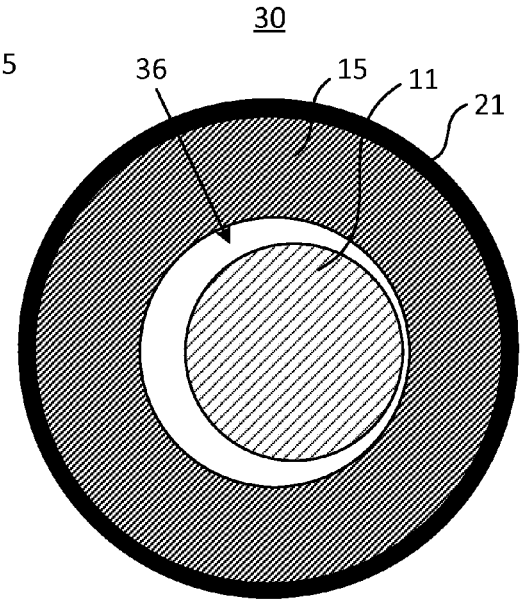
FIG. 3 is a cross-sectional view of another embodiment of a tire-encircling judderbarred cable loop having a single inner cable enclosed by a single flexible sleeve.

FIG. 3 shows a cross-sectional view of another embodiment 30 of a tire-encircling judderbarred cable loop according to the invention. The cross section is taken at view BB in FIG. 1. Cable loop 30 is characterized as having a single inner cable 11 enclosed by a single flexible layer or sleeve 15. An air gap 36 may occur between the cable 11 and the flexible sleeve 15. This view illustrates that one of the layers, in this case the inner cable 11, may be oriented slightly off-center with respect to an outer layer such as flexible layer 15, due to curvature of the cable loop assembly when forming the assembly into a loop. In this case, inner cable 11 and flexible layer 15 are still considered to be substantially concentrically aligned. In other words, flexible layer 15 substantially concentrically encloses the cable 11.

The cross-sectional view of cable loop 30 also shows the concentric orientation of the pipe cap 21 with respect to the other concentric layers. With reference to this view and to the top view of FIG. 1, pipe cap 21 can be seen covering an end of the flexible layer 21 where the major portion 17 of the cable borders the hitching portion 19 of the cable.

Figure 4:
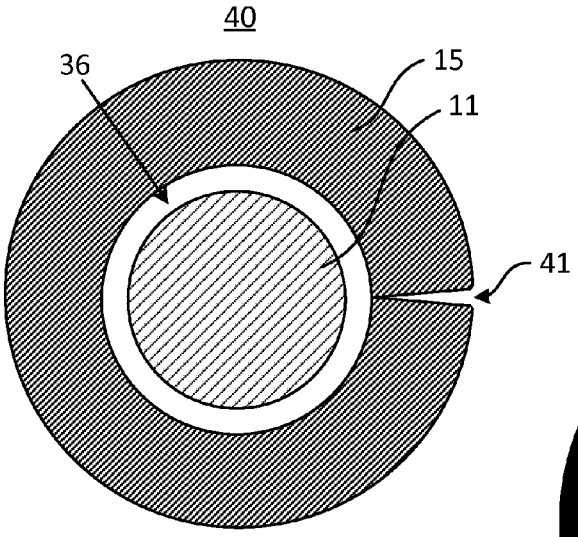
FIG. 4 is a cross-sectional view of another embodiment of a tire-encircling judderbarred cable loop having a single inner cable enclosed by a single flexible sleeve having a circumferential gap.

FIG. 4 is a cross-sectional view of another embodiment 40 of a tire-encircling judderbarred cable loop according to the invention. The cross section may also be taken at view AA in FIG. 1. This embodiment includes a single inner cable 11 enclosed by a single flexible sleeve 15. An air gap 36 may occur between the cable 11 and the flexible sleeve 15. Cable loop 40 is characterized by the flexible sleeve 15 having a circumferential gap or split 41, which runs along the entire circumference of the sleeve and which entirely penetrates the thickness of the sleeve, allowing it to be pulled open. Preferably, the flexible material 15 is selected with a resilient property that causes the flexible sleeve to re-close after being pulled opened across the gap. The gap 41 facilitates insertion of the cable 11 into the sleeve 15 without having to thread the cable lengthwise into the sleeve.

Figure 5:
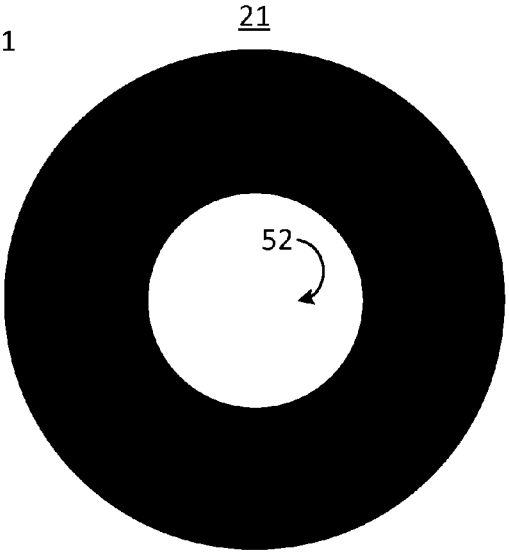
FIG. 5 is a top view of a pipe cap installed on the cable loop, as in the embodiment of FIG. 1, showing a through-hole sized for passage of cable.

FIG. 5 is a top view of a pipe cap 21 for installation on a tire-encircling judderbarred cable loop according to the invention. This view illustrates that the top cover of the cap has been modified by forming a through-hole 52 that is sized for passage of cable 11. For example, the pipe cap 21 may be drilled to define the through-hole 52 as being concentrically oriented with respect to the outer diameter of the pipe cap, and to define the through-hole 52 as having a diameter approximately equal to the diameter of the cable 11. In a preferred embodiment, the diameter of the through-hole 52 is preferably equal to or slightly less than the diameter of cable 11, to create a friction-fit of the pipe cap to the cable. The outer diameter of the pipe cap may be selected to slightly or significantly exceed the outer diameter of the flexible sleeve 15, as necessary, to prevent passage of the hitching ring 23 past the pipe cap. A silicon sealant (not shown) may be used to fill the pipe cap during installation, so that when cured the sealant prevents water and other foreign materials from entering into the flexible sleeve.

Figure 6:
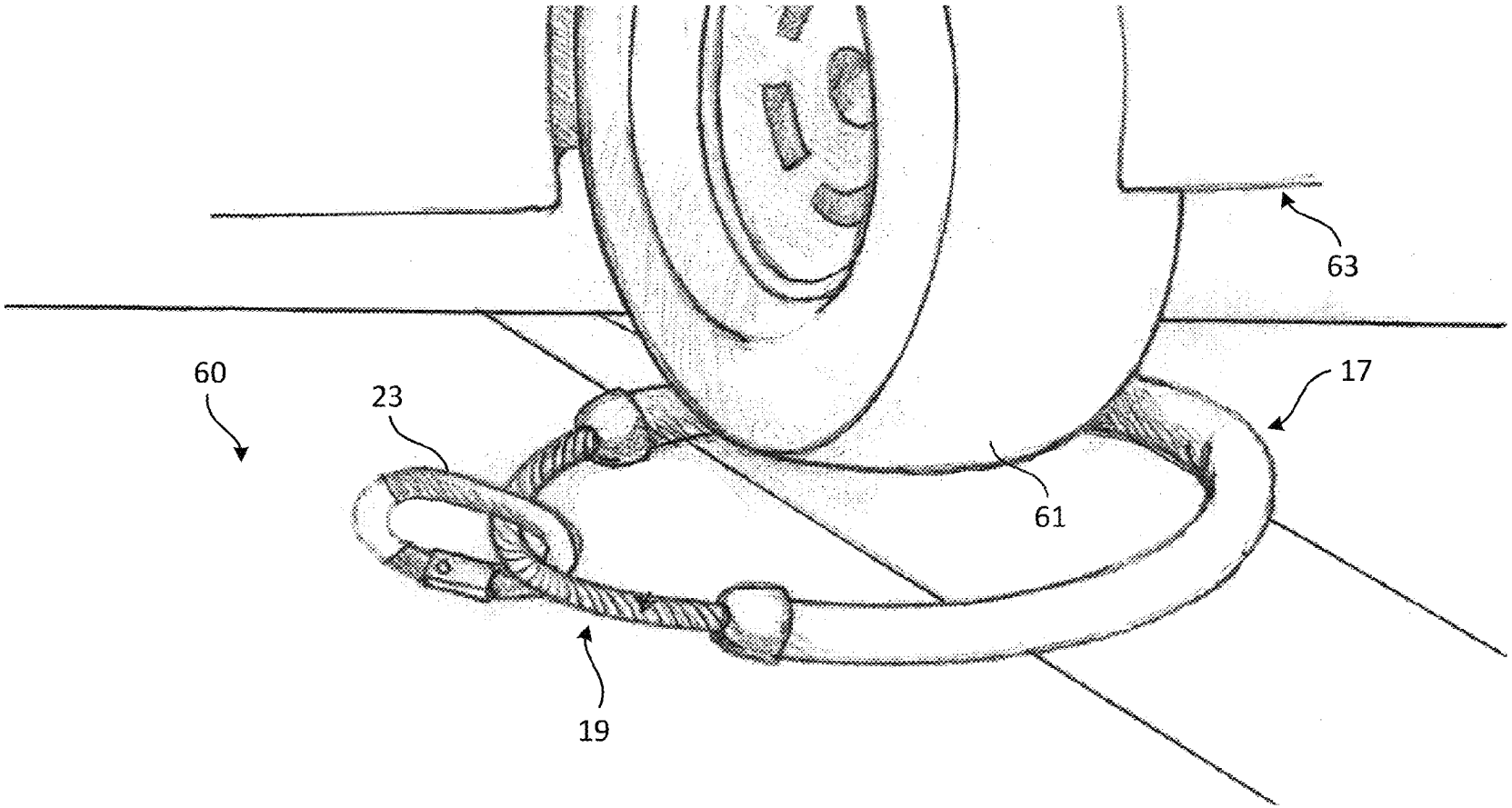
FIG. 6 is a perspective view of an embodiment according to the invention of a tire-encircling judderbarred cable loop shown encircling an automobile tire.

FIG. 6 is a perspective view of an embodiment according to the invention of a tire-encircling judderbarred cable loop 10 shown in a state of use. In this state, the cable loop 10 is resting on the ground 60 and encircling the contact area of tire 61 of an automobile 63. To achieve this state, a driver of the automobile 63 first places the cable loop 10 onto the ground right next to the tire so that the judderbarred portion 17 of the cable abuts the tire or rests in the direct path of the tire. The driver then slowly drives the automobile onto and over the judderbarred portion of the cable loop, and in doing so, the cable loop causes a humanly perceptible juddering signal to alert the driver through the suspension system of the automobile, so that the driver can discern when his tire has passed up and over the loop. The driver then parks the car with the tire 61 situated within the cable loop 10.

In this position, the judderbarred cable loop is confined by the tire and cannot be withdrawn from the area immediately surrounding the contact area of the tire. The driver or another user may now hitch an object of value—such as an animal, a bicycle, a portable grill, a sound system, a tool box, camping equipment, etc.—directly to the hitching portion 19 of the cable loop or to the hitching ring 23. Advantageously, the weight of the automobile will arrest or limit the movement of any object hitched to the judderbarred cable loop.

When the driver begins to drive away, the juddering effect of the cable loop will once again alert the driver when he drives the tire over the judderbarred portion of the cable loop. The river may then park the vehicle and retrieve the cable loop. In the event that the driver absent-mindedly begins to drive away before retrieving any objects of value that are hitched to the cable loop, the juddering signal will alert the driver to stop and retrieve those items before driving off.

To manufacture a tire-encircling judderbarred cable loop according to the invention, a length of cable 11 about four to eight feet in length may be cut from cable stock. The length should be sufficient to form a one to two square foot loop. Larger or smaller loops are also possible within the scope of the invention. Before attaching the cable at its opposite ends to form the loop, the cable may be inserted into a flexible sleeve 14 or 15. The sleeves may be cut from hose or tubing stock. The length of flexible sleeve or sleeves should be less than the length of the cable 11 to create the hitching portion 19. If both an inner flexible sleeve 14 and an outer flexible sleeve 15 are used, the cable 11 should be inserted first into the inner sleeve 14, then the inner sleeve 14 should be inserted into the outer sleeve 15. Pipe caps 21 and one or more hitching rings 23 may then be threaded onto the cable 11. The ends of the flexible sleeve or sleeves are then inserted into the pipe caps and preferably bonded with an adhesive or sealant. Finally, the opposite ends of the cable 11 are attached at the attachment point 13 by crimping, welding, or splicing to complete the loop.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A tire-encircling judderbarred cable loop, comprising:

steel cable having opposite ends attached;

one or more layers of flexible tubing substantially concentrically enclosing a major portion of the cable while exposing a hitching portion of the cable;

a pipe cap covering each end of the one or more layers of flexible tubing where the major portion of the cable borders the hitching portion of the cable, each pipe cap defining a through-hole concentrically located and allowing passage of the cable therethrough; and a hitching ring encircling the cable within the hitching portion, the hitching ring and pipe caps configured to allow travel of the hitching ring along the hitching portion between the pipe caps and to prevent the hitching ring from traveling beyond the hitching portion.

2. The tire-encircling judderbarred cable loop of claim 1 wherein the hitching ring has an inner diameter less than an outer diameter of the pipe caps.

3. The tire-encircling judderbarred cable loop of claim 1 wherein at least one of the layers of flexible tubing comprises a reinforced plastic hose having a thickness of about three-sixteenths inches.

4. The tire-encircling judderbarred cable loop of claim 1 wherein the cable comprises a plastic-coated stranded steel cable having a diameter of about one-quarter inch.

5. The tire-encircling judderbarred cable loop of claim 1 wherein the concentrically enclosed major portion of the cable is configured to impart a humanly perceptible juddering signal to a driver of the automobile when the tire rolls over the enclosed portion of the cable.

* * * * *